US005673301A

United States Patent [19]

Tekriwal

[11] Patent Number: 5,673,301

[45] Date of Patent: Sep. 30, 1997

[54] COOLING FOR X-RAY SYSTEMS

[75] Inventor: Prabhat Kumar Tekriwal, Schenectady, N.Y.

[73] Assignee: General Electric Company, Schenectady, N.Y.

[21] Appl. No.: 627,205

[22] Filed: Apr. 3, 1996

[51] Int. Cl.[6] ..... H01J 5/18

[52] U.S. Cl. ..... 378/130; 378/131; 378/141

[58] Field of Search ..... 378/141, 199, 378/200, 201, 202, 130, 131, 132, 133

[56] References Cited

U.S. PATENT DOCUMENTS

| | | | |
|---|---|---|---|
| 4,622,687 | 11/1986 | Whitaker et al. | 378/130 |
| 5,091,927 | 2/1992 | Golitzer et al. | 378/130 |
| 5,416,820 | 5/1995 | Weil et al. | 378/130 |

OTHER PUBLICATIONS

Publication entitled, "X-ray Protection With Insulated Tubes," by Plaats, G.J. van der, Medical X-ray technique, 2nd edition, 1961, pp. 34–35.

*Primary Examiner*—Don Wong

*Attorney, Agent, or Firm*—Patrick K. Patnode; Donald S. Ingraham

[57] ABSTRACT

A cooling system for an X-ray system with a bearing assembly having a bearing stator and a bearing rotor, includes a cooling stem disposed within the bearing assembly for dissipation of heat from the X-ray system. The cooling stem has dimensions adapted to be disposed within an axial bore of the bearing assembly. The cooling stem consists of a hollow, tubular housing having a target end, a distal end, and a number of radial fins integral with the outer surface of the tubular housing. The radial fins extend longitudinally from the target end in the direction of the distal end to a transition point. The radial fins, in combination with the outer surface of the tubular housing and the inner surface of the axial bore, form a number of axial channels for channeling a cooling medium from the target end to the distal end in a turbulent flow.

10 Claims, 4 Drawing Sheets

COOLING FOR X-RAY SYSTEMS

BACKGROUND OF THE INVENTION

The instant invention is directed in general to X-ray systems, and more specifically to improved cooling of the bearing assemblies therein.

An X-ray tube includes a cathode assembly and an anode assembly mounted in an evacuated glass frame or housing. The anode assembly includes a target in the form of a disk that is rotated at high speed adjacent to the cathode assembly, which cathode assembly emits an electron beam against a focal track adjacent to a perimeter of the target. A small portion of the electron beam is converted at the focal track into an X-ray beam which passes through a window in the housing for use in imaging or other conventional manners.

In an X-ray tube, less than about 1% of the electrical energy consumed by the tube is converted into X-rays, with the majority of the remaining energy producing waste heat in the target. Consequently, dissipation of the waste heat from the target is critical to the proper functioning of the X-ray tube. The X-ray tube is typically immersed in a cooling fluid, such as oil, which is channeled over the outside of the tube for removing the heat during operation. The heat generated at the target inside the tube housing, however, must also be dissipated to avoid overheating.

The X-ray tube is typically operated in cycles having one period in which X-rays are generated followed in turn by a cooling period to allow a reduction in temperature of the various components of the tube for preventing heat damage and eventual failure of the component parts. During the first few minutes of the cooling period, the heat transfer from the target is predominately radiational, with radiation heat transfer being proportional to the fourth power of temperature. After the initial radiation cooling period, heat transfer is dominated by conduction from the target through the remainder of the anode assembly to the tube housing.

Since the target rotates during operation, it is mounted on ball or journal bearing assemblies, the bearing assemblies themselves having temperature limits during operation. Conduction of heat from the target necessarily heats the supporting bearing assemblies, and ultimately decreases the life of this component of the X-ray tube.

In related art inventions, it is known to use a cooling medium flow into a cylindrical cavity of the bearing assembly to provide cooling for the bearing assembly. Typically, the cooling medium is forced into the cylindrical cavity to the end face of the cavity, and subsequently flows bask through a cooling duct within the cavity. Such a device is disclosed within a publication entitled "Leitfaden der medizinischen Rotgentechnik" by van der Plaats, 1961. Additionally, a cooling device inserted within a cavity to promote cooling is disclosed within Golitzer et al., U.S. Pat. No. 5,094,927. Golitzer discloses a cooling device inserted within a bearing cavity to distribute a cooling medium with turbulent flow for improved cooling of the bearing. Golitzer's disclosure, however, includes a plurality of discs which extend transversely to channel the cooling medium back and forth within the cavity to create a flow. This necessary additional movement of the cooling medium creates additional pumping costs within the Golitzer X-ray system.

Therefore, it is apparent from the above that there exists a need in the art for an apparatus for improved cooling of bearing assemblies within an X-ray tube. In particular, it is desirable for a cooling device to provide improved cooling effects within a bearing assembly without creating additional pumping costs associated with a complicated, back and forth movement of cooling medium within the device. It is a purpose of this invention, to fulfill this and other needs in the art in a manner more apparent to the skilled artisan once given the following disclosure.

SUMMARY OF THE INVENTION

The above-mentioned needs are met by the instant invention which provides an X-ray system with a bearing assembly having a bearing stator, a bearing rotor, and a cooling stem positioned within the bearing assembly for increased dissipation of heat from the X-ray system.

In one embodiment of the instant invention, the cooling stem is disposed within an axial bore of the bearing assembly and comprises a hollow, tubular housing having an inner surface, an outer surface, a target end, and a distal end. The cooling stem further comprises a plurality of radial fins integral with the outer surface of the tubular housing extending longitudinally from the target end in the direction of the distal end to a transition point. The radial fins, in combination with the outer surface of the tubular housing and the inner surface of the axial bore within the bearing assembly, form a number of axial channels for channeling a cooling medium from the target end to the distal end in a turbulent flow. Turbulent flow of the cooling medium within the axial channels provides higher heat transfer from the bearings then a cooling medium circulation system without turbulent flow.

Additionally, the structure of the instant cooling stem within an X-ray system, provides sufficient cooling flow that is predominantly longitudinal along the outer surface of the cooling stem. Therefore, the required X-ray system cooling flow is generated with less pressure head then is needed in related art X-ray systems, reducing the X-ray system pumping needs and cost.

BRIEF DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
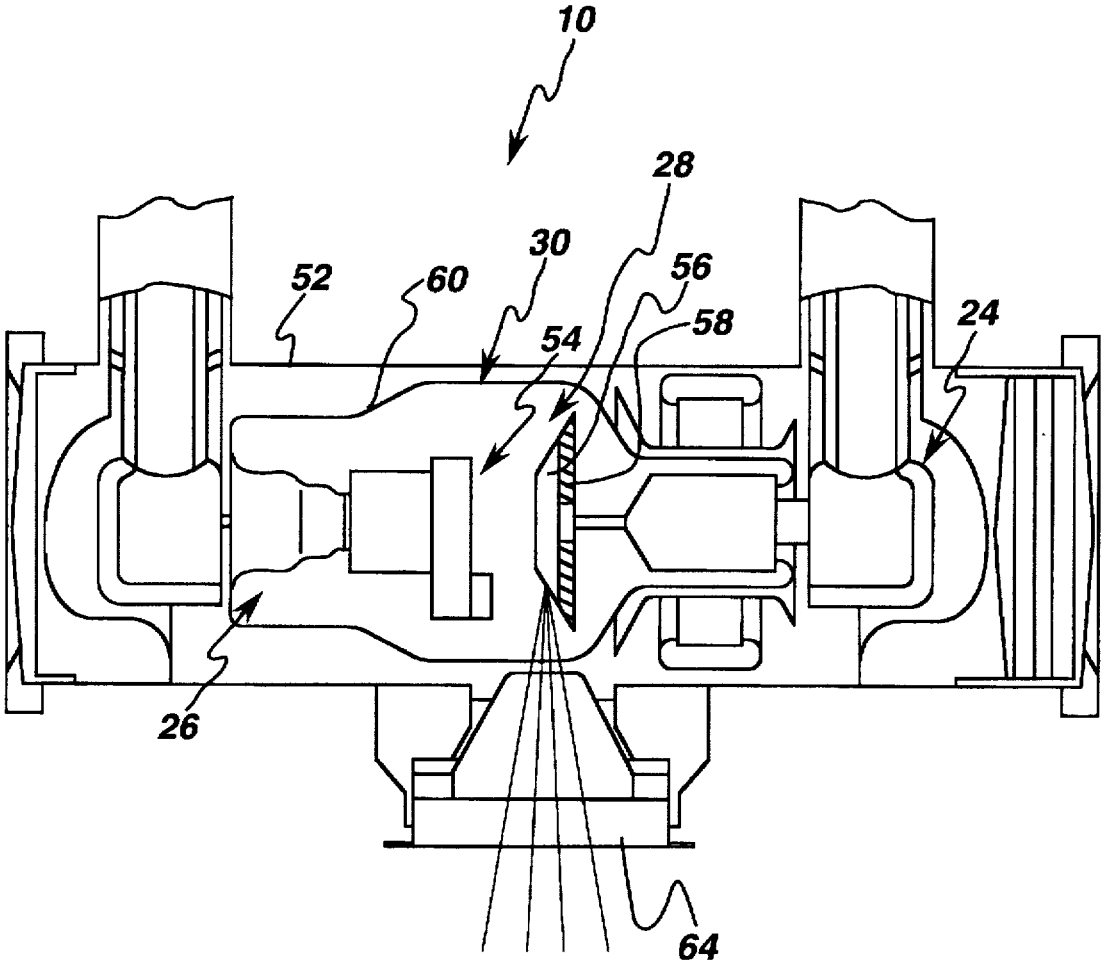
FIG. 1 is a cross-sectional view of a representative X-ray system having an X-ray tube positioned therein.

An X-ray system 10 comprises an anode assembly 24, a cathode assembly 26, and a center section 28 positioned between anode assembly 24 and cathode assembly 26. A representative X-ray system 10 is depicted in FIG. 1. Center section 28 contains an X-ray tube 30. X-ray system 10 further comprises a casing 52 typically made of aluminum and lined with lead, a cathode plate 54, and a rotating target 56 enclosed in an envelope 60, envelope 60 typically made of glass or metal. Target 56 typically has a backing plate 58, often made of graphite. Casing 52 is filled with a cooling medium, often oil, for cooling purposes. A window 64 for emitting X-rays is formed in casing 52, relative to target 56 for allowing generated X-rays to exit X-ray system 10.

X-ray tube 30 is operated in alternating periods of X-ray production and cooling to ensure that temperatures of tube 30 and the other X-ray system components are not overheated. The produced X-rays may be used for any conventional purpose.

Figure 2:
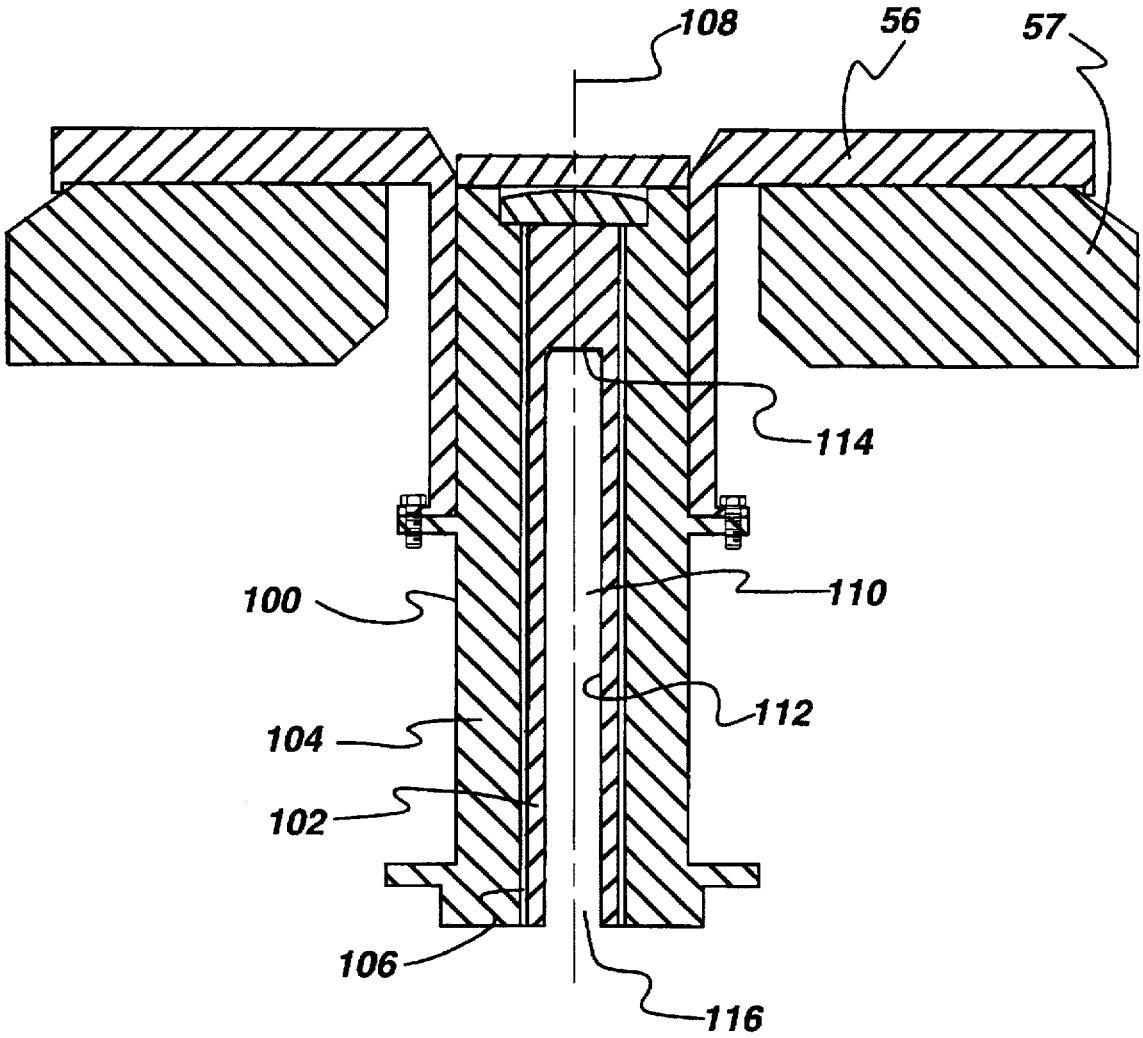
FIG. 2 is a plan view of one embodiment of the bearing assembly of the instant invention.

Referring to FIG. 2, there is shown a bearing assembly 100 including a bearing stator 102 and a bearing rotor 104 concentrically surrounding bearing stator 102 defining radially therebetween a journal annulus 106 for receiving a suitable lubricant such as liquid Gallium. Target 56 is rotatably supported by bearing assembly 100 which allows rotation of target 56 about a centerline axis 108 of X-ray tube 30. Within bearing stator 102 along centerline axis 108 is an axial bore 110 having an inner surface 112, a target end 114, disposed at the end of stator 102 closest to target 56, and a distal end 116, disposed at the end of stator 102 furthest from target 56.

Figure 3:
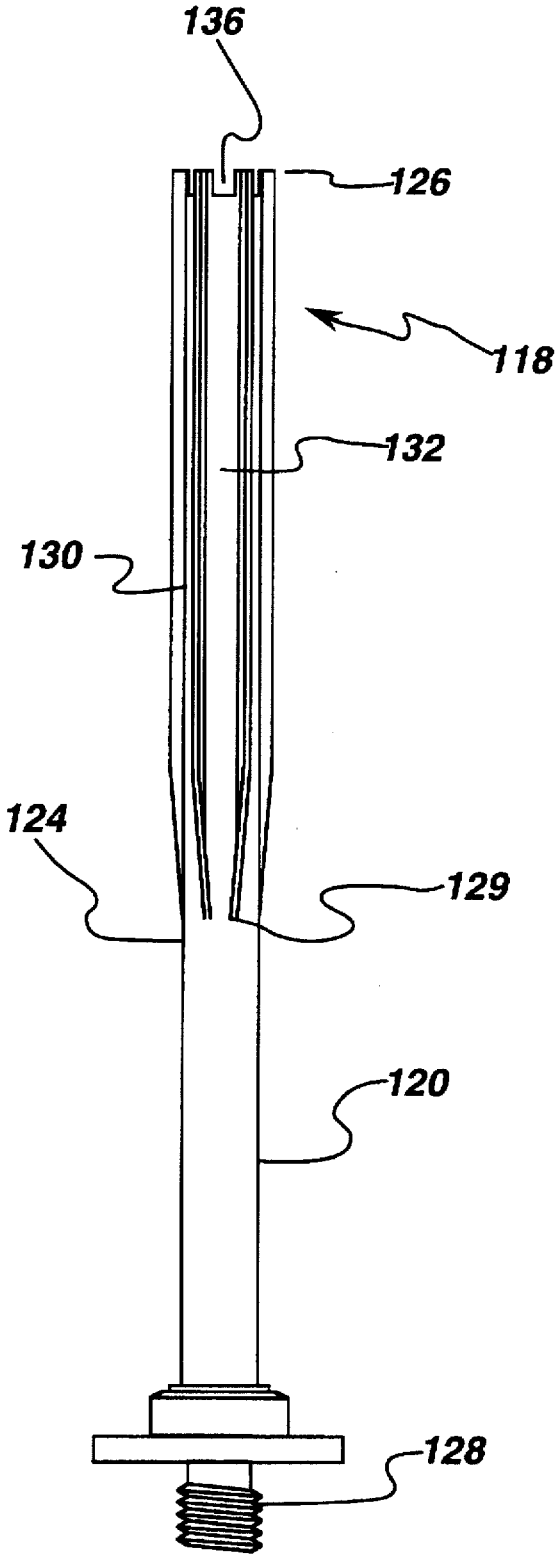
FIG. 3 is a plan view of one embodiment of the cooling stem of the instant invention.
Figure 4:
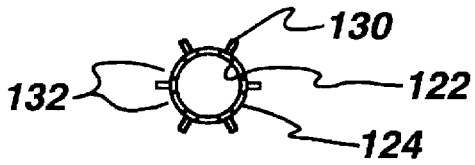
FIG. 4 is a target end view of one embodiment of the cooling stem of the instant invention.
Figure 5:
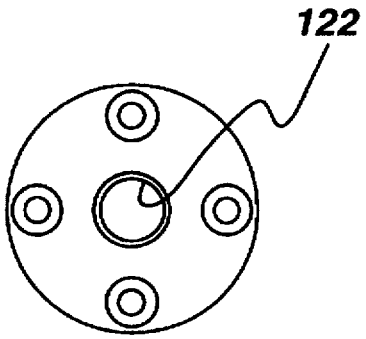
FIG. 5 is a distal end view of one embodiment of the cooling stem of the instant invention.

In accordance with the instant invention, a cooling stem 118 comprises a hollow, tubular housing 120 having an inner surface 122, an outer surface 124, a target end 126, and a distal end 128. Cooling stem 118 further comprises a plurality of radial fins 130 integral with outer surface 124 extending longitudinally from target end 126 in the direction of distal end 128 to a transition point 129. Cooling stem 118 is depicted in FIGS. 3–5.

Figure 6:
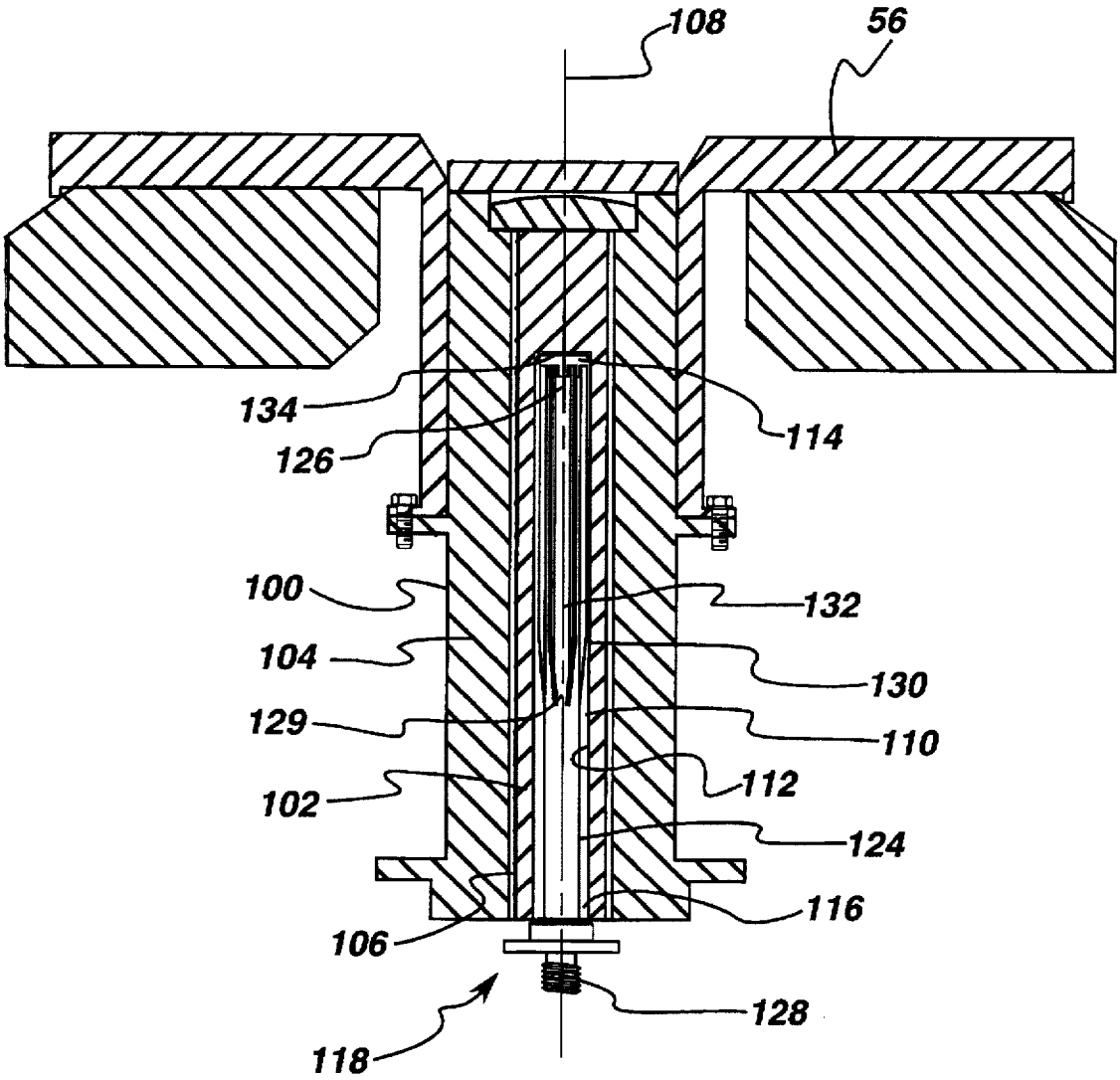
FIG. 6 is plan view of the cooling stem disposed within the bearing assembly as disclosed within the instant invention.

In accordance with the instant invention, cooling stem 118 is disposed within axial bore 110 of bearing assembly 100, as shown in FIG. 6. The dimensions of cooling stem 118 are selected such that cooling stem 118 is disposed within axial bore 110 so that target end 126 of cooling stem 118 is positioned at target end 114 of axial bore 110, leaving a gap 134 between cooling stem 118 and target end 114 of axial bore 110 for fluid flew. Distal end 128 of cooling stem 118 is positioned at distal end 116 of axial bore 110.

A plurality of axial channels 132 are defined by radial fins 130 in combination with outer surface 124 of tubular housing 120 and inner surface 112 of axial bore 110 within bearing assembly 100. Radial fins 130 are sized such that the flow Reynolds number of axial channels 132 is within the turbulent region, for example above 2000. Cooling stem 118 comprises aluminum or the like. In one embodiment, at least one cooling medium notch 136 (FIG. 3) is provided at target end 126 of cooling stem 118 to allow cooling medium flow from inner surface 122 (FIG. 4) to axial channels 132.

During operation, heat is conducted from hot target 56 through bearing stator 102, bearing rotor 104, and the lubricant within journal annulus 106. The temperature of bearing assembly 100 is highest at the areas closest to target 56. In order to cool these areas, a cooling medium, often oil, is pumped from a cooling medium supply (not shown) through distal end 128 of cooling stem 118, along the path of arrow A in FIG. 6. The cooling medium flows through inner surface 122 (FIG. 4) of cooling stem 118 to target end 114 of axial bore 112 and is forced out of gap 134 between cooling stem 118 and target end 114 so that cooling medium flows from target end 126 towards distal end 128 over outer surface 124 of cooling stem 118 through axial channels 132.

As mentioned above, the size of fins 130 is chosen such that the flow Reynolds number of axial channels 130 is within the turbulent region, for example above 2000. Turbulent flow results in much higher heat transfer coefficients than laminar flow. Axial channels 132 create a turbulent flow of the cooling medium. This turbulent flow increases the heat transfer coefficient at target end 114 of axial bore 112 and correspondingly enables an increased dissipation of heat from bearing assembly 100. The heat from the hot bearing stator 102, bearing rotor 104, and the lubricant within journal annulus 106 at target end 114 of bearing assembly 100 is removed into the turbulent flow of cooling medium to distal end 128 of cooling stem 118 and out to a cooling source (not shown), connected to cooling stem 118, where the heat is removed from the cooling medium. In this way, heat is more effectively removed from X-ray bearing assembly 100, the enhanced heat transfer enabling more frequent operation cycles while maintaining bearing assembly 100 within necessary temperature limits.

Because heat travels via conduction from hot target 56 to bearing rotor 104, the lubricant within journal annulus 106, and bearing stator 102, a temperature gradient is established in the axial direction of bearing rotor 104, the lubricant within annulus 106, and bearing stator 102. Due to this axial gradient, a higher heat transfer coefficient is needed at target end 114 of bearing assembly 100 and a relatively lower heat transfer coefficient is sufficient at distal end 116 of bearing assembly 100. A high heat transfer coefficient, in general, requires a higher pressure drop to maintain the required cooling medium flow. A higher pressure drop necessitates larger pump capacity or longer pump operation and an overall increase in pumping costs.

Accordingly, in one embodiment of cooling stem 118, radial fins 130 run in a longitudinal direction from target end 126 only to a transition point 129 between target end 126 and distal end 128, and at transition point 129, angle, at some transitioning slope, often between 4° and 11°, to outer surface 124, creating one annular path at distal end 128 of cooling stem 118. In this embodiment, the higher pressure drop needed to maintain the high heat transfer coefficient is required only for the flow within axial channels 132, which corresponds to the high temperature region closest to target 56. The heat transfer needs of bearing assembly 100 are reduced in the regions further away from hot target 56, therefore, the high heat transfer coefficient is no longer required. Accordingly, at transition point 129, fins 130 slope, at some angle, back to outer surface 124, creating one annular path at distal end 128 cooling stem 118, and lowering the pumping requirements for X-ray system 10. The pumping requirements for this embodiment of cooling stem 118 are thereby significantly lower than would be needed if cooling channels 132 were to run the entire length of cooling stem 118.

While only certain features of the invention have been illustrated and described herein, many modifications and changes will occur to those skilled in the art. It is, therefore, to be understood that the appended claims are intended to cover all such modifications and changes as fall within the true spirit of the invention.

We claim:

1. A cooling stem having dimensions adapted to be disposed within an axial bore of an X-ray bearing assembly, said axial bore having an inner surface, said cooling stem comprising:

a hollow, tubular housing having an inner surface, an outer surface, a target end and a distal end;

said tubular housing further comprising a plurality of radial fins integral with said tubular housing outer surface and extending longitudinally from said target end in the direction of said distal end to a transition point; and said radial fins disposed along said outer surface such that said fins in combination with said inner surface of said axial bore form a plurality of axial channels for channeling a cooling medium from said target end to said distal end in a turbulent flow.

2. A cooling stem, in accordance with claim 1, wherein said cooling stem comprises aluminum.

3. A cooling stem, in accordance with claim 1, wherein said radial fins, at said transition point, angle at a transitioning slope to said outer surface of said tubular housing creating one annular path of flow at said distal end of said tubular housing.

4. A cooling stem, in accordance with claim 3, wherein said transitioning slope is between 4° and 11°.

5. A cooling stem, in accordance with claim 1, wherein said radial fins and said outer surface of said hollow, tubular housing are sized such that the flow Reynolds number of said axial channels is within the turbulent region.

6. An X-ray system having a rotatable target assembly, comprising:

a bearing assembly disposed to rotatably support said target assembly, said bearing assembly comprising a bearing stator, a bearing rotor, and an axial bore having an inner surface; and a cooling stem having dimensions adapted to be disposed within said axial bore, said cooling stem comprising a hollow, tubular housing having an inner surface, an outer surface a target end, a distal end, a plurality of radial fins integral with said outer surface of said tubular housing extending longitudinally along said tubular housing from said target end in the direction of said distal end to a transition point, said radial fins in combination with said outer surface of said tubular housing and said inner surface of said axial bore forming a plurality of axial channels for channeling a cooling medium from said target end to said distal end in a turbulent flow.

7. An X-ray system, in accordance with claim 6 wherein said cooling stem comprises aluminum.

8. An X-ray system, in accordance with claim 6, wherein said radial fins, at said transition point, angle, at a transitioning slope to said outer surface of said tubular housing creating one annular path of flow at said distal end of said tubular housing.

9. An X-ray system, in accordance with claim 8, wherein said transitioning slope is between 4° and 11°.

10. An X-ray system, in accordance with claim 6, wherein said radial fins and said outer surface of said hollow, tubular housing are sized such that the flow Reynolds number of said axial channels is within the turbulent region.

* * * * *